US005512802A

United States Patent [19]

Jamar

[11] Patent Number: 5,512,802

[45] Date of Patent: Apr. 30, 1996

[54] COLOUR DISPLAY TUBE INCLUDING A CONVERGENCE CORRECTION DEVICE

[75] Inventor: Jacobus H. T. Jamar, Eindhoven, Netherlands

[73] Assignee: U.S. Philips Corporation, New York, N.Y.

[21] Appl. No.: 159,395

[22] Filed: Nov. 30, 1993

[30] Foreign Application Priority Data

Nov. 30, 1992 [EP] European Pat. Off. ..... 92203686

[51] Int. Cl.[6] ..... G09G 1/28; H01J 29/51; H01J 29/74; H01H 1/00

[52] U.S. Cl. ..... 315/368.25; 315/368.28; 313/436; 335/213; 336/200

[58] Field of Search ..... 315/368.25, 368.26, 315/368.28; 336/200, 232; 313/436, 438; 335/213

[56] References Cited

U.S. PATENT DOCUMENTS

| | | | |
|---|---|---|---|
| 3,098,942 | 7/1963 | Reiches . | |
| 3,368,095 | 2/1968 | Jannery | 335/213 |
| 3,702,450 | 11/1972 | Avery et al. | 335/213 |
| 4,027,219 | 5/1977 | Van Alphen et al. | 315/368 |
| 4,642,527 | 2/1987 | Takahashi et al. | 315/368.24 |
| 5,095,357 | 3/1992 | Andoh et al. | 336/200 |

FOREIGN PATENT DOCUMENTS

| | | |
|---|---|---|
| 223988 | 12/1983 | Japan . |
| 58-223088 | 12/1983 | Japan . |

*Primary Examiner*—Gregory C. Issing
*Attorney, Agent, or Firm*—Robert J. Kraus

[57] ABSTRACT

Convergence correction device for a color display tube comprising a rolled-up flexible support provided with two convergence correction coil systems at its inner surface as well as its outer surface. The coils of each system are of the spiral-shaped type and are interconnected via metallized apertures by means of an electrically conducting strip at the opposite circumferential surface. Dependent on the specific configuration, the flexible support is wound once or twice around the neck of the display tube.

13 Claims, 10 Drawing Sheets

COLOUR DISPLAY TUBE INCLUDING A CONVERGENCE CORRECTION DEVICE

BACKGROUND OF THE INVENTION

The invention relates to a display device having a colour display tube and a display screen with a tube neck located opposite said screen, and a convergence correction device comprising an arrangement of correction coils around the tube neck for generating correction fields.

U.S. Pat. No. 4,027,219 describes a device in which eight or twelve coils (solenoids) wound on cores of a ferromagnetic material are arranged in a row around the tube in such a way that their axes are coplanar, while they are incorporated in a circuit having controllable current sources in such a way that, upon energization, two four-pole fields and two six-pole fields are generated whose intensity and polarity are controllable for obtaining (static) convergence of the coplanar (red, green and blue) electron beams.

Drawbacks of the use of such a configuration of solenoids are:

- the insensitivity, requiring a convergence circuit with relatively expensive amplifiers;
- the little freedom of design as regards the exact field shape;
- the complicated electric circuit which is required to generate all desired multipolar fields with a limited number of coils, and
- the limited suitability for dynamic convergence due to the large self-inductance of the solenoids.

SUMMARY OF THE INVENTION

It is, inter alia, an object of the invention to provide a construction which does not have the above-mentioned drawbacks or which has these drawbacks to a lesser extent.

According to the invention, the display device with the display tube of the type described in the opening paragraph is therefore characterized in that the convergence correction device has a support which surrounds the robe neck, in that a first system of at least one set of associated correction coils of the spiral type is arranged on a first (inner) circumferential surface and a second system on a (outer) circumferential surface of the support, and in that at least two correction coils of each system are electrically interconnected via metallized apertures in the support by means of an electrically conducting strip which is arranged on the opposite circumferential surface.

The invention is based on the use of (coreless) coils of the spiral type with conductor turns which are present on a (cylindrical) surface. This provides the possibility of easily placing such a system of coils or a plurality of coil systems in a position close to the neck glass of the display tube (small diameter of the cylinder) so that a high sensitivity is possible. The inductance is low due to the absence of cores. For this concept use is made of spiral coils (referred to as print coils) which may be arranged on an inner surface and an outer surface of a flexible support (or foil) by means of a printing technique, the support surrounding the tube neck in such a way that the axes of the coils are radially directed towards the axis of the tube neck. This provides a great freedom of design. More particularly, for each correction field to be generated (particularly four and six-pole fields) a separate coil system can be used, which coil systems can be separately controlled in a simple manner.

In accordance with a first embodiment, a system of two sets of four (print) coils each for generating a four-pole x field and a four-pole y field, respectively, and/or a system of two sets of six (print) coils for generating a six-pole x field and a six-pole y field, respectively, are arranged on the flexible support. A practical embodiment is characterized in that a set of four coils for generating the one four-pole field and/or a set of six coils for generating the one six-pole field are arranged on one of the circumferential surfaces of the support, and a set of four coils for generating the other four-pole field and/or a set of six coils for generating the other six-pole field are arranged on the other circumferential surface. For simple interconnections, the respective four-pole field systems and six-pole field systems are preferably located opposite each other in slightly offset positions. Each one of the correction coil systems generating a four-pole field and a six-pole field subtends an angle of approximately 360° so that the foil provided with coils in the manner described above must be wound twice around the display tube. To prevent short-circuits between the rolled-up layers, it is efficient to provide an electrically insulating layer across the coil systems at at least one side of the foil.

To realise the required interconnections in a simple and practical manner, the coils of the coil systems are preferably arranged in such a way that at least a part of the connection strips is located in a free intermediate area (window) of a coil or in an area between two adjacent coils.

The coils for generating 2N pole fields may be of the spiral type with concentric outer turns surrounding a central window. However, the coils have a greater sensitivity if, in accordance with a preferred embodiment of the invention, they are of the type having outer turns surrounding an outer window and inner turns surrounding at least one inner window. Outer and inner window(s) may be concentric or not concentric.

Instead of correction coil systems each subtending an angle of 360°, use can be made of correction coil systems each subtending an angle of approximately 180° in accordance with a special embodiment of the invention. A foil whose inner surface and outer surface are provided with such correction coil systems need only be wound once around the tube neck, which is a considerable advantage (for example, a minimum surface area of foil to be used).

An embodiment of the invention is characterized in that one system of coils for red-x correction, one system of coils for red-y correction, one system of coils for blue-x correction and one system of coils for blue-y correction is arranged on the inner and outer circumferential surfaces of the flexible support. It is efficient when the coil system for the one red correction is arranged on the outer circumferential surface at approximately half a turn of the support and the coil system for the other red correction is arranged on the inner circumferential surface, and when the coil system for the one blue correction is arranged on the outer circumferential surface at the other half turn and the coil system for the other blue correction is arranged on the inner circumferential surface.

BRIEF DESCRIPTION OF THE DRAWING

These and other aspects of the invention will be apparent from and elucidated with reference to the embodiments described hereinafter. In the drawings

DESCRIPTION OF THE PREFERRED EMBODIMENTS

Figure 1:
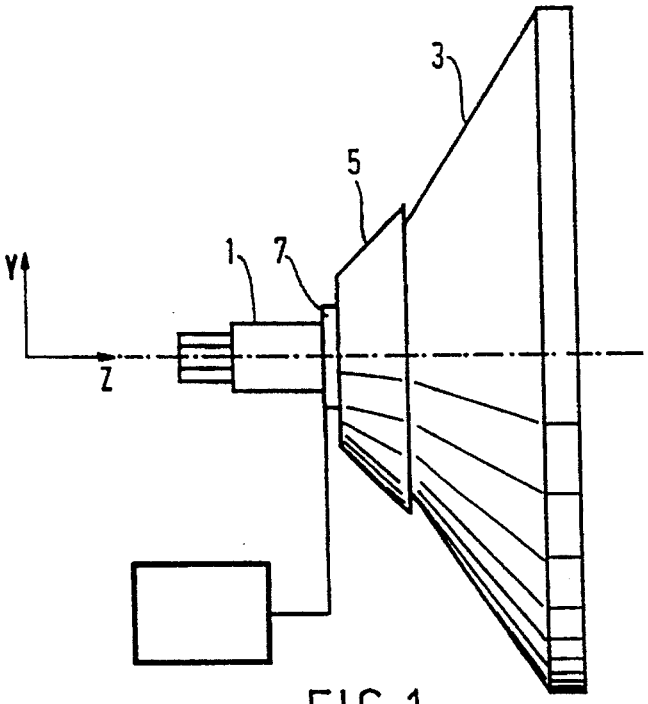
FIG. 1 shows diagrammatically a display tube including a deflection unit and a convergence correction device.
Figure 2:
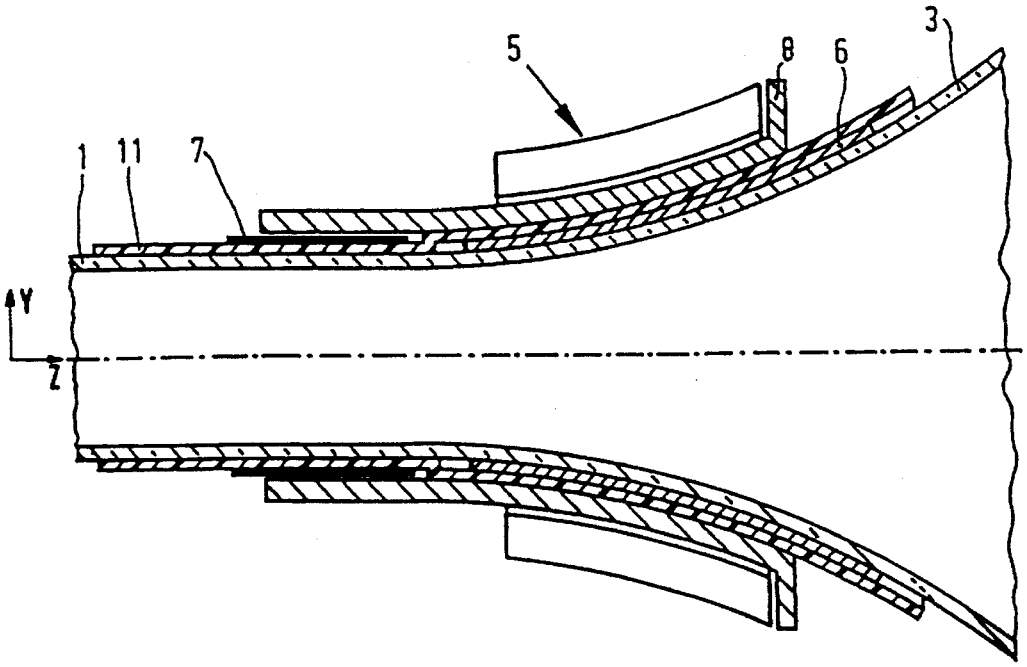
FIG. 2 shows a larger detail of the construction shown in FIG. 1.
Figure 3A:
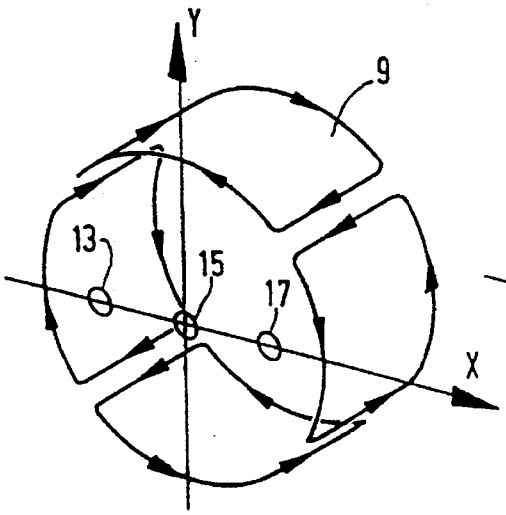
FIGS. 3A and 3B show diagrammatically embodiments of four-pole field correction coil systems.
Figure 3B:
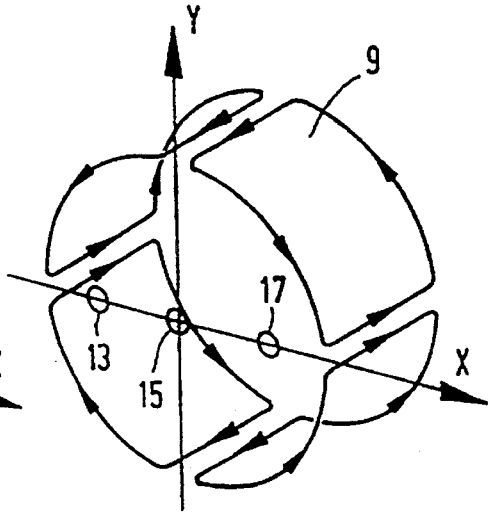
Figure 3C:
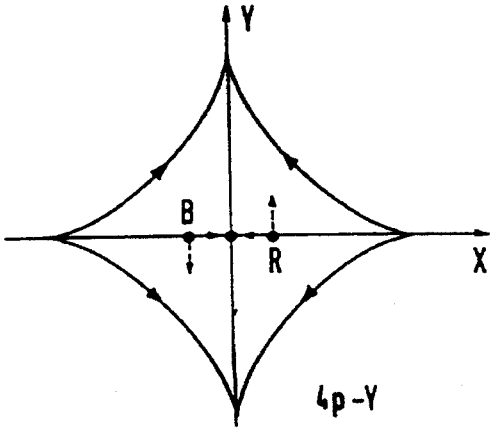
FIGS. 3C, 3D, 3E and 3F show a four-pole y field, a four-pole x field, a six-pole x field and a six-pole y field, respectively, and the effects on the outer electron beams.
Figure 3D:
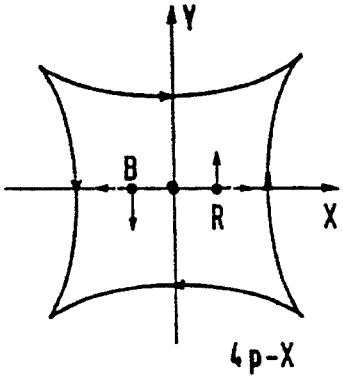

The colour display tube shown diagrammatically in FIG. 1 has a cylindrical neck portion accommodating electron guns (not visible in FIG. 1) for generating three approximately coplanar electron beams, and a funnel-shaped portion 3. A deflection unit 5 is arranged at the area of the interface between the two portions. This unit comprises a coil support 11 which in this example supports a line deflection coil system 6 and a field deflection coil system 8, both of the type having a flat gun-sided end. A convergence correction device 7 is accommodated within the gun-sided end of field deflection coil system 8. This correction device may comprise a plurality of coils 9 formed as spirals directed radially towards the axis of the tube neck 1 and being arranged in a holder 11 secured to the neck in such a way that their axes are coplanar. When the coils 9 are connected to one or more current sources, magnetic fields resulting particularly in a displacement of the outer electron beams 13, 17 are generated within the tube neck 1. Red-blue y errors (y astigmatic errors) can be corrected by means of four coils (referred to as four-pole y coils) which are positioned and energized in the way as shown in the embodiment of FIG. 3A. Red-blue x errors (x astigmatic errors) can be corrected by means of four coils (referred to as four-pole x coils) which are positioned and energized in the way as shown in the embodiment of FIG. 3B. In fact, a four-pole field having a horizontal axis direction produces a vertical displacement of the outer beams 13, 17 in opposite directions (see FIG. 3C) and a four-pole field having an axis direction at 45 degrees to the horizontal produces an opposite displacement in the horizontal direction (see FIG. 3D).

Figure 3E:
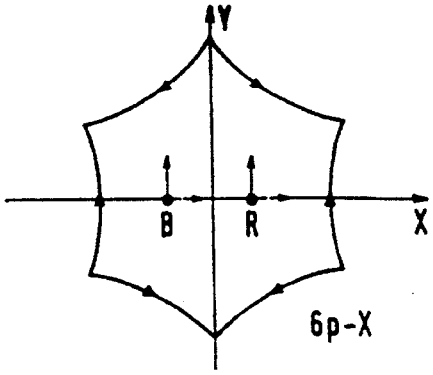
Figure 3F:
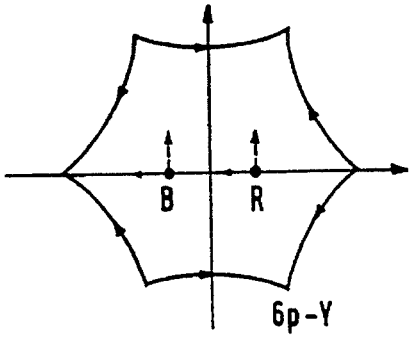

The red and blue beams can be moved in the same direction parallel to the x axis (six-pole x coils: see FIG. 3E) or parallel to the y axis (six-pole y coils: see FIG. 3F) by means of a system of six coils which are positioned in the correct way to generate the desired six-pole field.

Figure 4A:
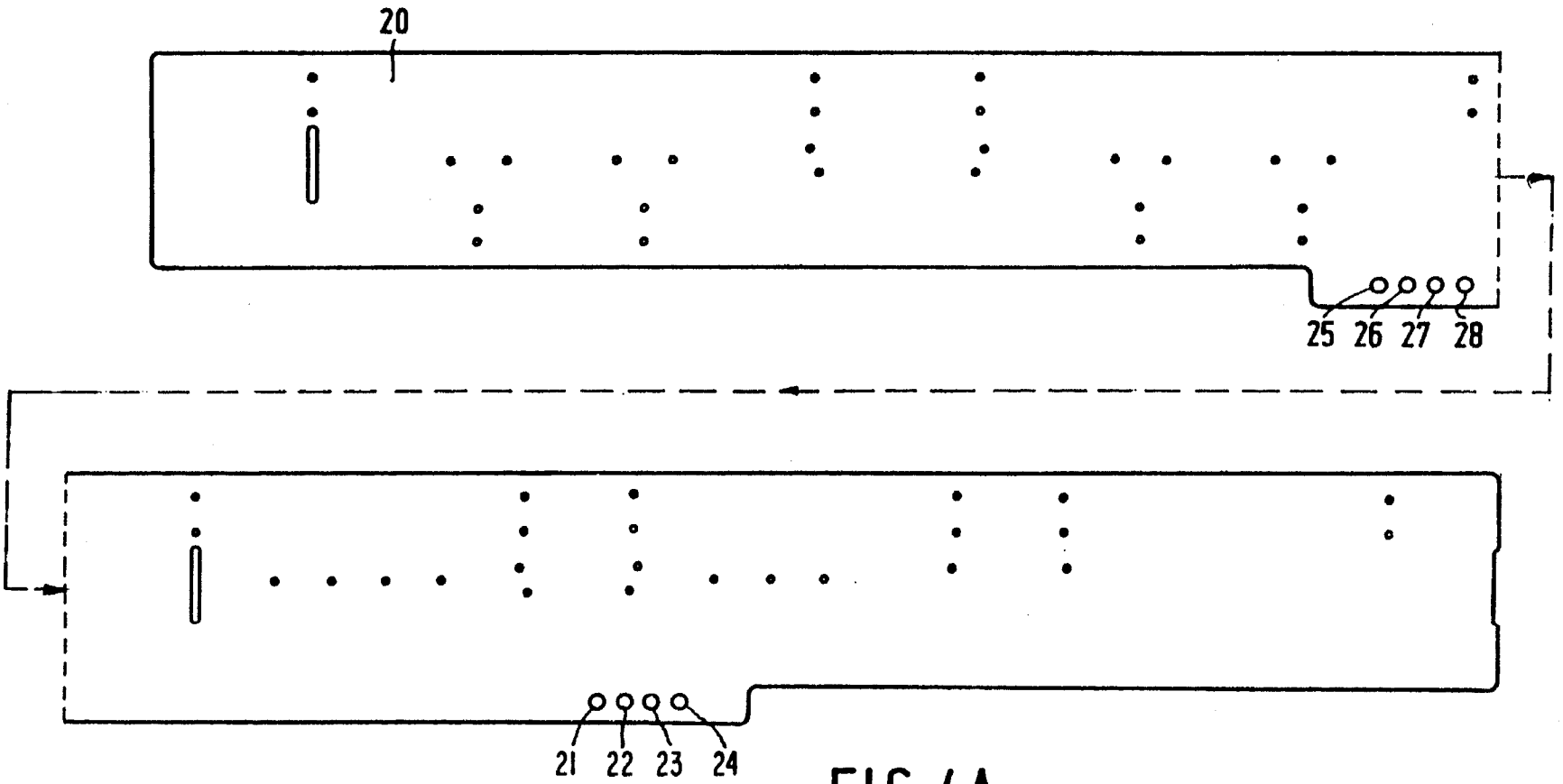
FIG. 4A shows a correction coil support in an unfolded shape.

FIG. 4 shows an arrangement of correction coils of the above-described types on a flexible support, in this case a synthetic material foil 20 (FIG. 4A). The foil 20 has a large number of metallized apertures 21, 22, 23, 24, 25, 26, 27, 28, etc. for through-connection and connection of the correction coils.

Figure 4B:
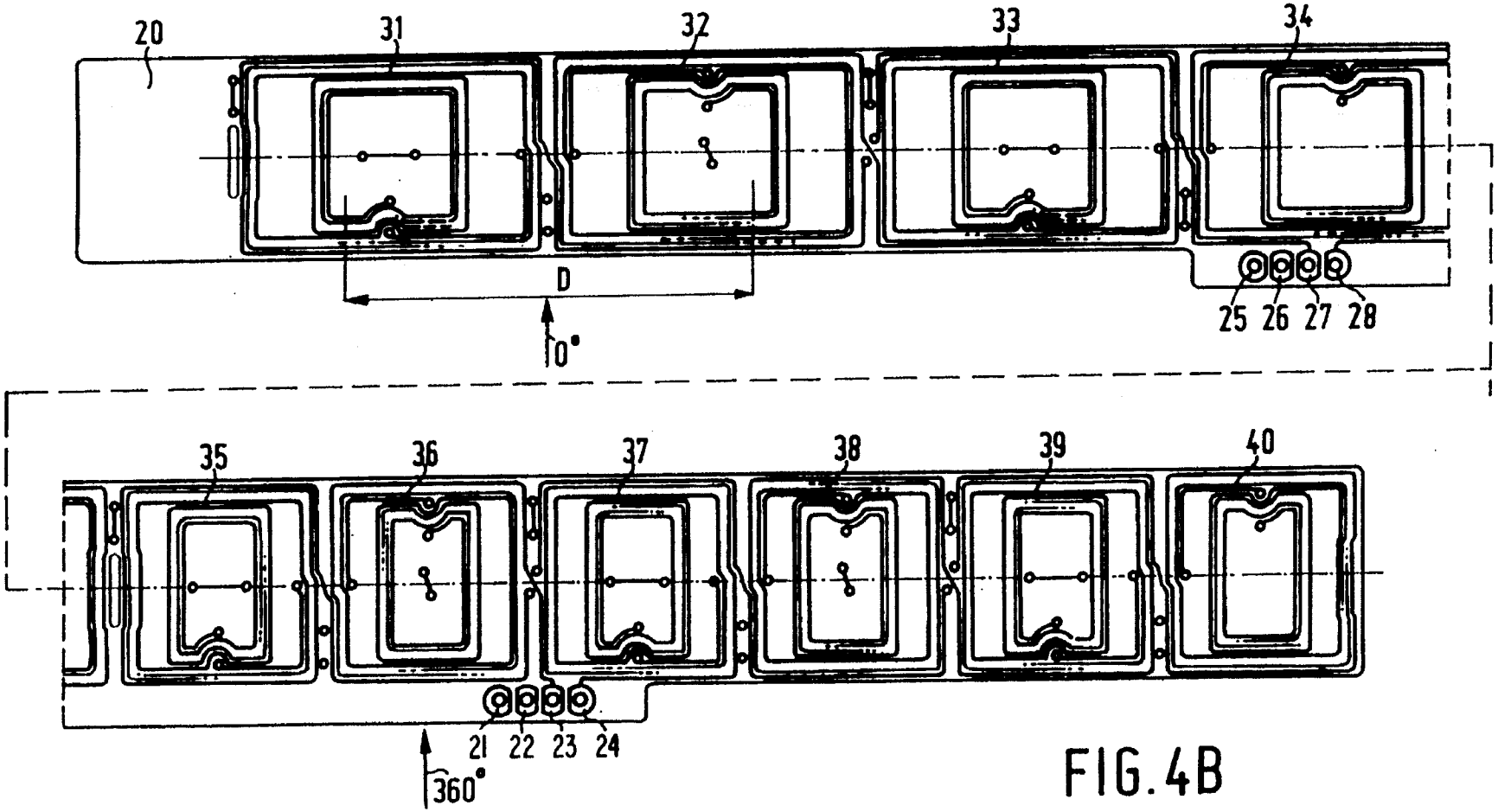
FIG. 4B shows the conductor pattern at the upper side of the correction coil support of FIG. 4, with the two correction coil systems.

FIG. 4B shows the upper side of the support 20 provided with four spiral-shaped coils 31–34 which constitute a four-pole x correction coil system when they subtend an angle of 360°, and six spiral-shaped coils 35–40 which jointly constitute a six-pole y correction coil system when they subtend an angle of 360°.

Figure 4C:
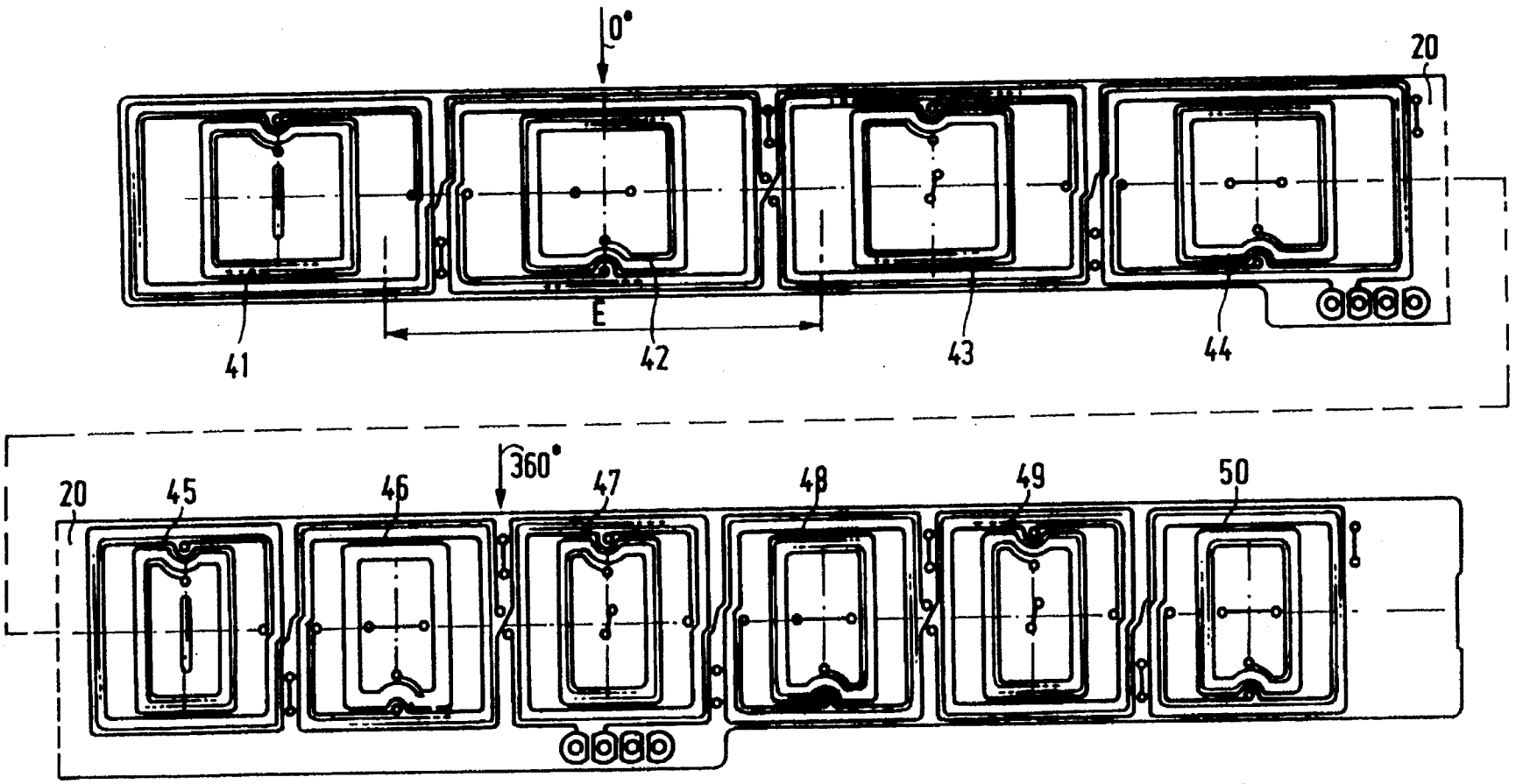
FIG. 4C shows the conductor pattern at the lower side of the correction coil support of FIG. 4, with two additional correction coil systems.

FIG. 4C shows the conductor pattern at the lower side of the support 20 with four spiral-shaped coils 41–44 which constitute a four-pole y correction coil system and six spiral-shaped coils 45–50 which constitute a six-pole x correction coil system. (Note: all elevational views have been taken from the same viewing direction). The metallized apertures 25, 26 constitute the connections for the four-pole y coils and the metallized apertures 27, 28 constitute the connections for the four-pole x coils, while the metallized apertures 21, 22 constitute the connections for the six-pole x coils and the metallized apertures 23, 24 constitute the connections for the six-pole y coils.

In this embodiment the support 20 with the correction coil systems is rolled up twice before assembly. The angular positions which are taken up by the coil conductors extending parallel to the longitudinal axis of the tube after assembly are shown in FIGS. 4B and 4C. Angular position 0° coincides with the x axis.

Figure 4D:
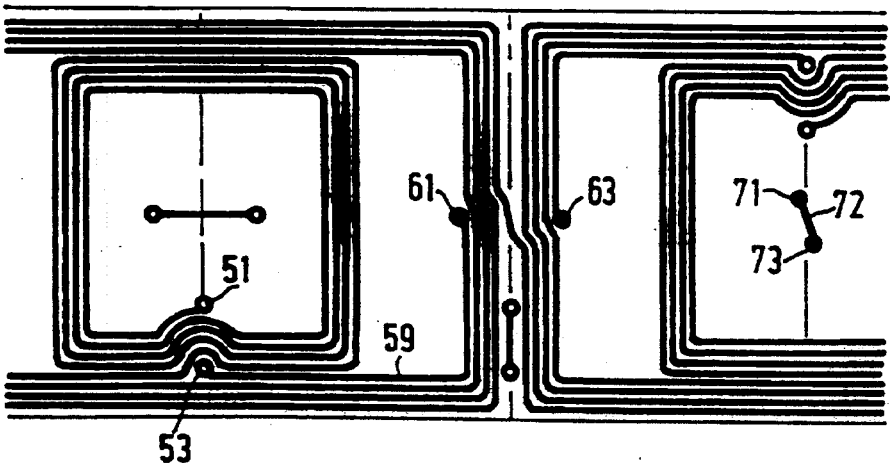
FIG. 4D is a plan view of a pan of FIG. 4B on a larger scale.
Figure 4E:
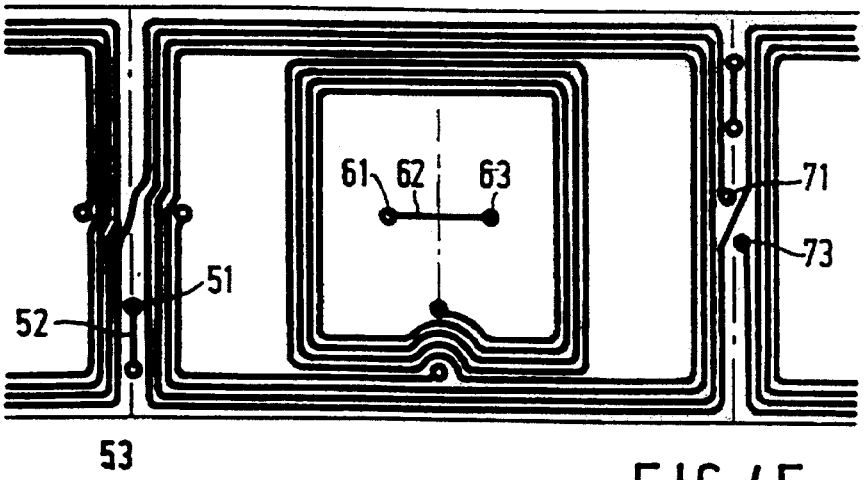
FIG. 4E is a plan view of the opposite part of FIG. 4C on a larger scale.

As is shown in FIGS. 4D and 4E an important aspect of the invention is that connection strips are used at the opposite side of the support and metallized apertures for the through-connections of the coils. As regards these through-connections, it is troublesome that the "other" side is already occupied by another (four-pole or six-pole) coil system. However, it still appears to be possible to realise a support provided with correction coils at two sides by situating the through-connections either within the window of a coil at the other side or in the space between two coils at the other side. In this respect it is important that the one four-pole coil system is arranged opposite the other four-pole coil system and the one six-pole coil system is arranged opposite the other six-pole coil system. The inner end of the coil 31 is connected via a metallized aperture 51, a transverse strip 52 situated at the opposite side between the coils 41 and 42 and a metallized aperture 53 to a conductor track 59 which is situated further to the outer end of the coil 31, which outer end is in its turn connected via an aperture 61, a longitudinal strip 62 situated at the other side within the window of the coil 42 and an aperture 63 to a point for through-connecting the coil 32. The arrows in the coils 31, 32, 33, 34, etc. indicate the direction of the current upon energization.

A third type of through-connection (in addition to the above-mentioned transverse strip 52 and the longitudinal strip 62) is the oblique strip 72 situated within the window of coil 32, which strip interconnects the outer ends of the coils 42 and 43 via metallized apertures 71 and 73. These three types of through-connections are found a number of times in the conductor patterns of FIGS. 4B and 4C.

The embodiment of FIG. 4, with two correction coil systems per turn (one at the inner side and one at the outer side via the support) implies that two turns of the support are required for the four coil systems. Another embodiment of a double-sided foil provides the possibility of using one turn only. To realise this, correction coil systems each subtending an angle of approximately 180° instead of 360° are used, i.e. each occupies approximately half a turn of the support. The reason therefor is that no four-pole coil systems and six-pole coil systems are used (which can move both outer beams with respect to the central beam), but coil systems which can move one outer beam with respect to the two other beams. This is referred to as red-x, blue-x, red-y and blue-y corrections, respectively. The operation will be explained by way of example with reference to FIG. 5.

Figure 5A:
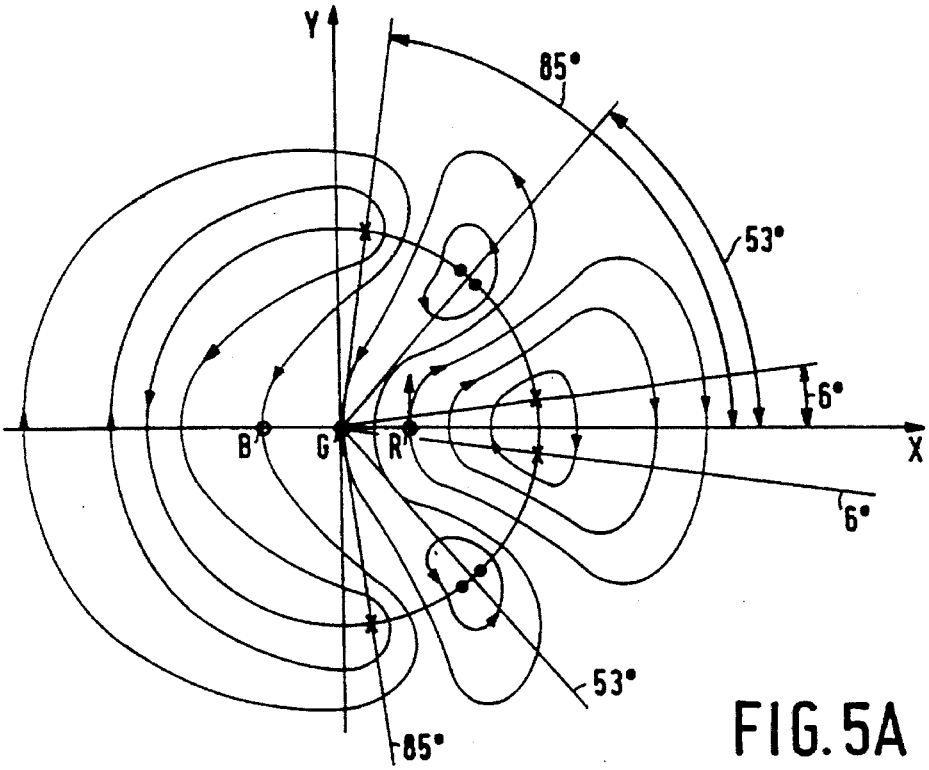
FIG. 5A shows a conductor and field line pattern associated with a red-x correction coil.

FIG. 5A illustrates the red-x correction. The circles and crosses at the circumference of the circle indicate the positions of the turns; the current direction is, for example "into the sheet" for the crosses and "out of the sheet" for the circles. The field line pattern shown indicates that a strong vertically directed magnetic field prevails at the location of the red beam (i.e. the red beam is deflected strongly to the right), while a weak magnetic field prevails at the location of the blue and green beams (which field is preferably equal for blue and green). The latter can be realised by a suitable choice of the angles of the turns, for example, 6°,53°,53° and 85°, and −6°, −53°, − 53° and −85° with respect to the x axis. Generally, suitable configurations are obtained when the longitudinal conductor portions of the coils are situated at angular positions between 0° and 12°, between 45° and 60°, between 75° and 90° and the mirror images with respect to their x axis.

Figure 5B:
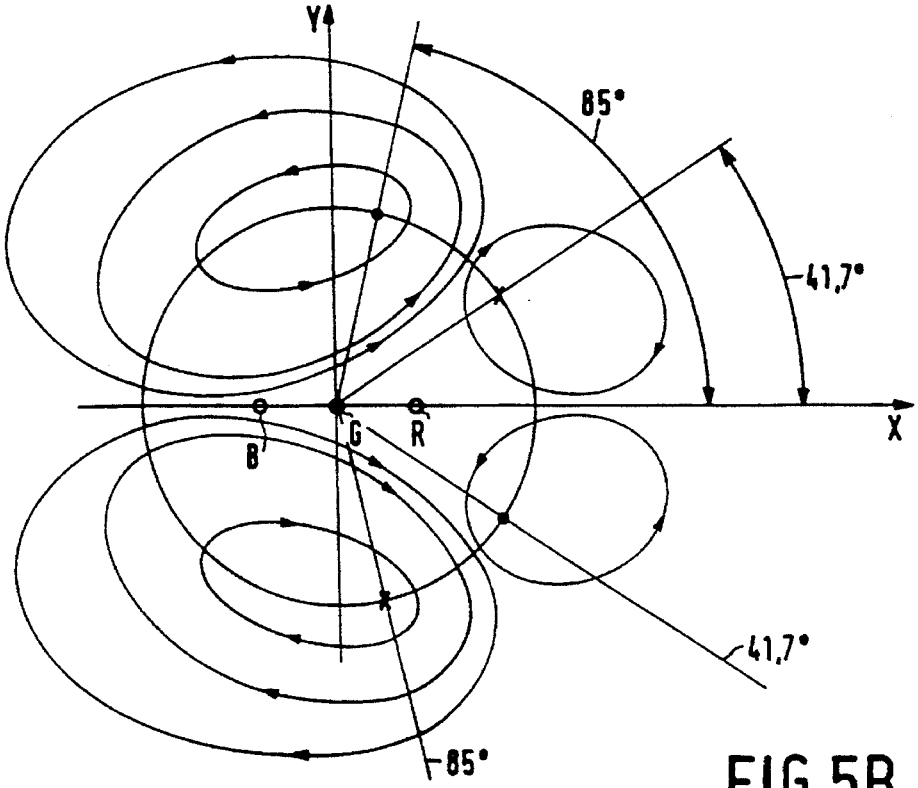
FIG. 5B shows a conductor and field line pattern associated with a red-y correction coil.

FIG. 5B illustrates the red-y correction. Again, a (substantially) equal magnetic field (now in the x direction) prevails at the location of B and G, and a magnetic field having a considerably different strength prevails at the location of R. The field at R is almost zero, but this does not make any difference for the convergence effect because B and G are moved vertically with respect to red to the same extent. Consequently, a red-y correction is still realised. Suitable angles are, for example 45° and 85°; however, to fit a red-x and a red-y correction opposite each other at both sides of a double foil, 41.7° and 85° and their mirror images with respect to the x axis are more suitable. Generally, suitable configurations are obtained when the longitudinal conductor portions of the coils are situated at angular positions between 30° and 50° and between 75° and 90° and the minor images with respect to their x axis.

Figure 6A:
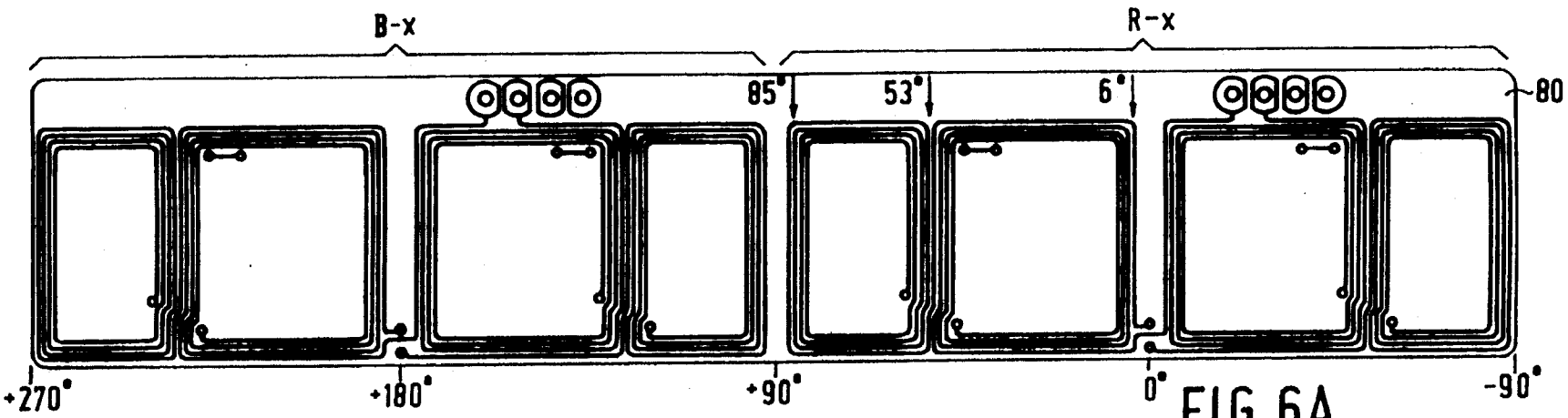
FIG. 6A shows a circumferential surface of a correction coil support with two coil systems for red-x (R-x) and blue-x (B-x) correction, respectively.
Figure 6B:
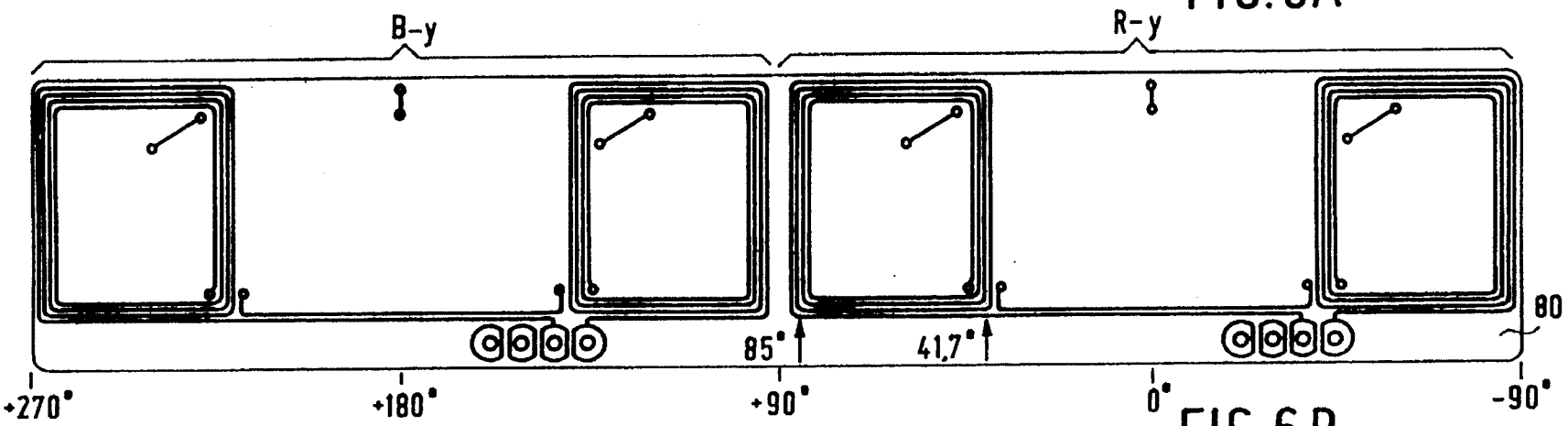
FIG. 6B shows the opposite circumferential surface of the correction coil support of FIG. 6B with two coil systems for red-y (R-y) and blue-y (B-y) correction, respectively.

FIG. 6A shows a conductor pattern provided on a support 80 with a red-x (R-x) and a blue-x (B-x) correction coil system in accordance with the above-mentioned concept. FIG. 6B shows a conductor pattern provided on the opposite surface of the support with a red-y (R-y) and a blue-y (B-y) correction coil system which is the counterpart of the pattern of FIG. 6A. (The elevational views of the conductor patterns have been taken from opposite viewing directions.) After assembly, the coil systems for red correction are thus situated at one half turn (for example, x correction inside, y correction outside) and the coil systems for blue correction are situated at the other half turn (also, for example x correction inside, y correction outside). In this case the support 80 is wound approximately once around the neck of the display tube. The through-connections of the coils in this embodiment are also realised in the shape of transverse, longitudinal or oblique strips located within the coil windows or between the coils and arranged on the opposite surface of the support and the metallized apertures.

The fact that, for example for the red-y correction red itself is not displaced, but blue and green are jointly displaced implies a raster side effect of the convergence correction. In practice this raster effect is sometimes undesirable. The same holds true for the blue-y correction. This can be amended by adding extra turns in the shape of an auxiliary coil having a current intensity which is a given fraction of the current intensity in the other turns. However, these additional turns cannot remain within half a turn. By suitable choice of the angular positions of all turns and of said fraction, all of the 4 corrections can be realised on one turn of double-sided foil. See FIGS. 7 and 8. Here the angular positions are 34.4° (relative current intensity 1), 66°, (intensity+⅓), 81.6° (intensity−1) and 159° (intensity+⅓).

Figure 7:
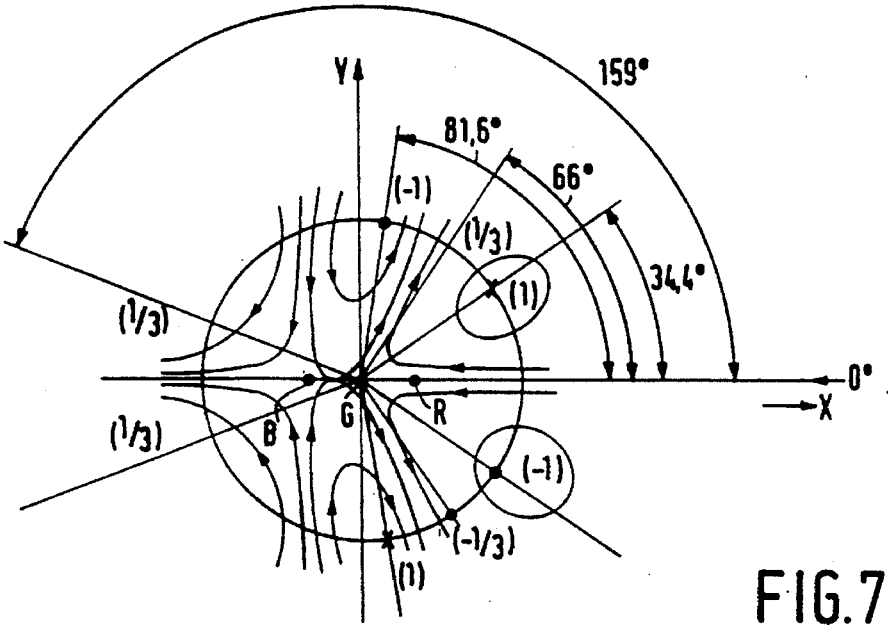
FIG. 7 shows a field line pattern associated with an alternative red-y correction.

FIG. 7: diagrammatical representation of the principle, the angular positions of (the points of gravity of) the conductor portions and the field lines of the generated magnetic field.

Figure 8:
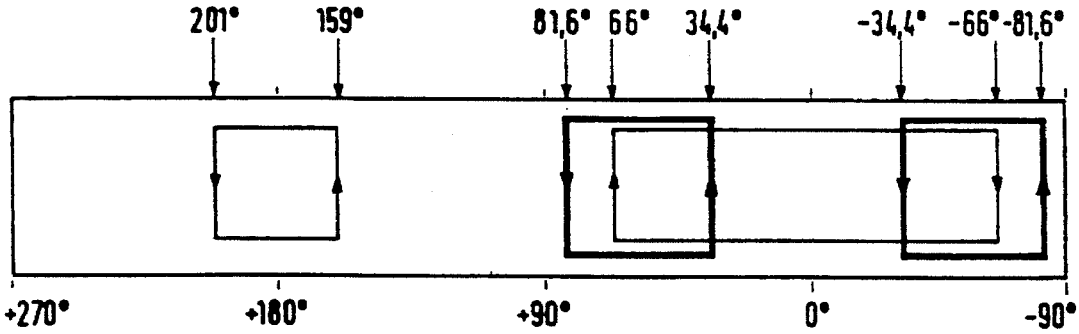
FIG. 8 shows diagrammatically a support having a conductor pattern for generating the field line pattern of FIG. 7.

FIG. 8: diagrammatical representation of the conductor pattern on the support. The fat lines indicate the turns of relative current intensity 1 (=approximately the pattern of the unimproved y correction), the thin lines indicate the (added) tracks of current intensity fraction *1: as it were, two conductor loops, or auxiliary coils, have been added, one of which partly overlaps the original pattern. All loops should comprise suitable numbers of turns (in connection with the fraction; the fraction should thus be the quotient of two integers) and should be preferably interconnected so that one current is sufficient to energize the entire correction in the correct manner.

Suitable configurations are generally obtained when the angular positions of the longitudinal conductor portions of the coils for red-y correction differ from the above-mentioned angular positions by not more than 10°.

It will be evident that a pattern of auxiliary coils can be added to the blue-y correction coil pattern in FIG. 6B similar to the red-y correction coil pattern (FIG. 8).

Figure 9:
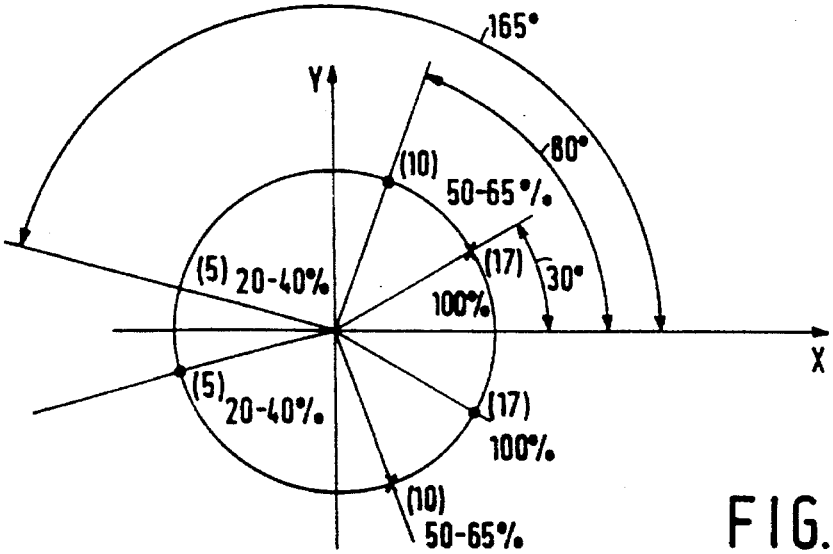
FIG. 9 shows a conductor pattern associated with another red-y correction.

In connection with the sensitivity (millimeters of convergence effect per ampere) it may be necessary to give the coils a relatively large number of turns. Since the conductor tracks cannot be made arbitrarily narrow, this may give rise to problems with the through-connections. The invention provides an attractive solution to this problem in that the design of FIG. 8 is modified in such a way that the conductor portions of the respective angular positions 66° and 81.6° and −66° and −81.6° "coincide". Since opposite currents flow through these conductor portions, they "annihilate" each other partially. It is thus sufficient to use locally fewer turns. A through-connection may also be dispensed with. Moreover, a more favourable design can be realised if the "fraction" (current intensity in the auxiliary coils with respect to the current intensity in the main coils) is not required to be equal for the two auxiliary loops. The resultant design for situating the points of gravity of the longitudinal conductor portions of the adapted red-y correction coil is shown in FIG. 9. The number of turns and the fraction are indicated for each point along the circumference of the circle.

Figure 10A:
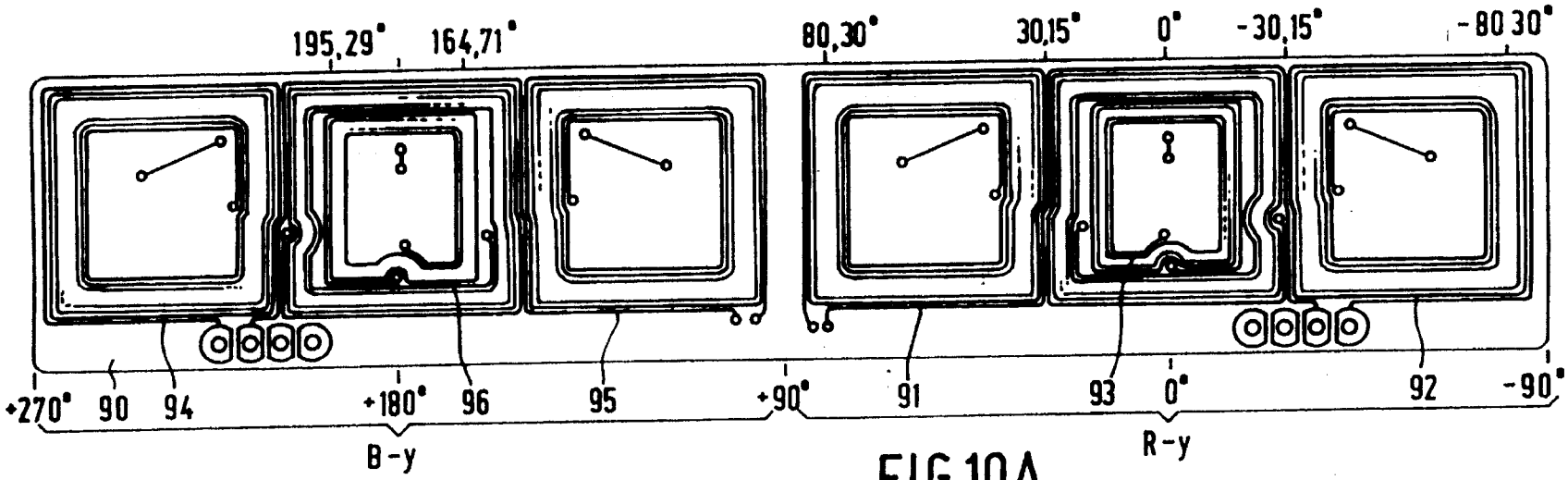
FIG. 10A shows an alternative to the construction of FIG. 6B.

An elaboration is shown in FIG. 10A. This Figure shows the upper side of a support 90 with a main correction coil system 91, 92 for red-y (R-y) correction between which an auxiliary correction coil 93 is arranged which has been added to the main correction coil system 94, 95 for blue-y (B-y) correction. An auxiliary correction coil 96 added to the coil system 91, 92 is arranged between the coils 94, 95. The Figure shows the angular positions for the R-y system. The differences in numbers of turns in the different coil portions can clearly be seen.

Figure 10B:
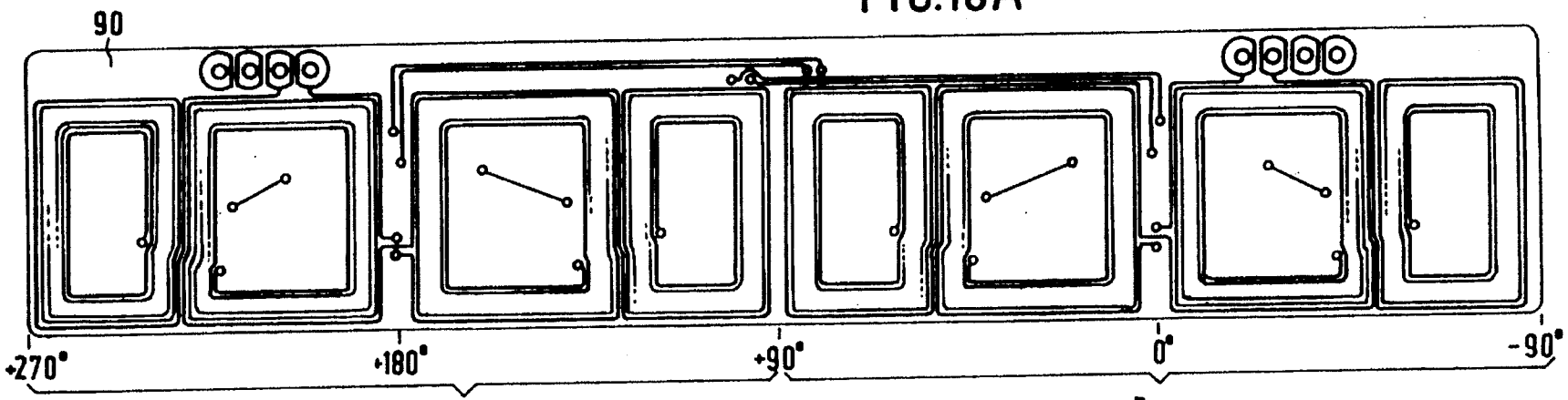
FIG. 10B shows an alternative to the construction of FIG. 6A.

The way in which the coils of FIG. 10A are through-connected is shown in FIG. 10B showing the conductor pattern at the lower side of the support 90. The coil systems for blue-x correction and red-x correction at this side correspond to the coil systems shown in FIG. 6A. (The viewing directions in FIGS. 10A and 10B are opposed to each other.)

Figure 11:
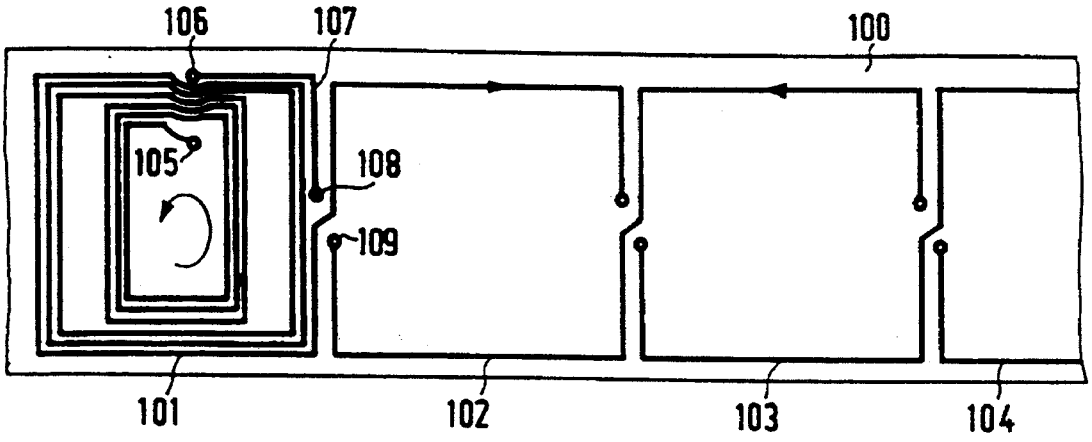
FIG. 11 shows diagrammatically a correction coil system having alternative interconnections.

FIG. 11 shows diagrammatically a conductor pattern having an increased density for a four-pole correction coil system 101 . . . 104. Coil 101 has an inner end 105 which is connected to a connection point 106 of the outer turn 107 of the coil 101 via a (transverse) connection strip at the opposite side of the support 100. The outer turn 107 terminates at a connection point 108 which is connected to a connection point 109 of the outer turn of coil 102 via an (oblique) connection strip at the opposite side of the support 100. Since two outer windings are through-connected, the "crossing" may be very short and fit in narrow coil window at the opposite side.

It is to be noted that the flexible convergence coil supports described hereinbefore can be mounted in different ways (after they have been rolled up). For example, such a support may be mounted around an electrically insulating (synthetic material) ring. An alternative solution is to accommodate the rolled-up support within a cylinder of electrically insulating material. At its outer side, such a cylinder may have one or more plug housings with electrically conducting pins making contact with the metallized connection apertures of the support.

I claim:

1. A display device having a display tube provided with a display screen and a tube neck located opposite thereto, and including a convergence correction device which comprises an arrangement of correction coils disposed around the neck for producing correction fields, characterized in that the arrangement of correction coils comprises:

a. an insulating support surrounding the tube neck and having opposite first and second sides and a plurality of metallized aperture extending through said support from the first side to the second side;

b. a first system of spiral coils formed of first conductors disposed on the first side of the insulating support, at least first and second ones of said coils having respective first and second electrical connection points which are disposed on opposite sides of at least one of said first conductors and are electrically connected to respective adjacent first and second ones of said metallized apertures;

c. a second system of spiral coils formed of second conductors disposed on the second side of the insulating support, at least one of the coils in the second system being offset with respect to one of the coils in the first system to provide an area on said second side which is separate from said second conductors and includes said first and second metallized apertures; and d. an interconnecting conductor disposed on the second side of the insulating support in said area for electrically connecting the first and second metallized apertures.

2. A display device as in claim 1 wherein the area lies within a window formed by one of the coils in the second system.

3. A display device as in claim 1 where the area lies between adjacent ones of the coils in the second system.

4. A display device as in claim 1 where one of said first and second systems comprises four coils for producing a four-pole field having an x axis in a predetermined direction and the other one of said first and second systems comprises four coils for producing a four-pole field having a y axis in a direction transverse to the predetermined direction.

5. A display device as in claim 1 where one of said first and second systems comprises six coils for producing a six-pole field having an x axis in a predetermined direction and the other one of said first and second systems comprises six coils for producing a six-pole field having a y axis in a direction transverse to the predetermined direction.

6. A display device as in claim 1 where:

a. one of said first and second systems comprises four coils for producing a four-pole field having an x axis in a predetermined direction and comprises six coils for producing a six-pole field having an x axis in said predetermined direction; and b. the other one of said first and second systems comprises four coils for producing a four-pole field having a y axis in a direction transverse to the predetermined direction and six coils for producing a six-pole field having a y axis in said direction transverse to the predetermined direction.

7. A display device as in claim 1 where the first and second systems of spiral coils are offset with respect to each other.

8. A display device as in claim 7 where the first and second systems of spiral coils are offset circumferentially with respect to each other.

9. A display device as in claim 1 where said systems of spiral coils includes:

a. a system of coils for red x correction;

b. a system of coils for red y correction;

c. a system of coils for blue x correction; and d. a system of coils for blue y correction; said insulating support being wound only once around the tube neck.

10. A display device as in claim 9 where one of said red correction coil systems and one of said blue correction coil systems are disposed on respective halves of the first side of the insulating support, and where the other one of said red correction coil systems and the other one of said blue correction coil systems are disposed on respective halves of the second side of the insulating support.

11. A display device as in claim 1 where said at least one coil in the second system is offset circumferentially with respect to said one coil in the first system.

12. A display device as in claim 1 where a plurality of the coils in the second system are offset with respect to a plurality of adjacent ones of the coils in the first system to provide a plurality of areas on the second side which are separate from the second conductors, where a plurality of interconnecting conductors are disposed on the second side in respective ones of said areas, and where connection points of pairs of said adjacent coils are electrically connected to each other via respective ones of said interconnecting conductors which are electrically connected to said coil connection points via respective ones of the metallized apertures in said support.

13. A display device as in claim 1 where each of the first and second sides of the insulating support includes a plurality of areas which are separate from the conductors forming the coils on the respective side, and includes respective interconnecting conductors disposed on said side in said areas which are electrically connected via respective ones of the metallized apertures in said support to respective ones of the coil connection points on the opposite side.

* * * * *